United States Patent [19]

Landoni

[11] 4,089,281

[45] May 16, 1978

[54] CONTROL DEVICE OF A NEEDLE-BEARING IN A QUILTING MACHINE

[75] Inventor: Giannino Landoni, Fagnano Olona, Italy

[73] Assignee: Meca S.n.c., Cassano Magnago, Italy

[21] Appl. No.: 726,758

[22] Filed: Sep. 27, 1976

[30] Foreign Application Priority Data

Oct. 3, 1975 Italy ..... 27932 A/75

[51] Int. Cl.[2] ..... D05B 55/14

[52] U.S. Cl. ..... 112/221; 112/79 A; 112/83; 112/98; 112/117

[58] Field of Search ..... 112/83, 84, 87, 98, 112/117, 79 R, 79 A, 221; 403/DIG. 1; 192/84 PM

[56] References Cited

U.S. PATENT DOCUMENTS

| | | | |
|---|---|---|---|
| 435,875 | 9/1890 | Wilcox et al. | 112/87 X |
| 1,162,009 | 11/1915 | Zahn | 112/83 |
| 2,886,149 | 5/1959 | Baermann | 192/84 PM X |
| 2,956,658 | 10/1960 | Jaeschke | 192/84 PM |
| 3,235,047 | 2/1966 | Weiss | 192/84 PM |
| 3,266,448 | 8/1966 | Haggar | 112/84 |

FOREIGN PATENT DOCUMENTS

| | | | |
|---|---|---|---|
| 510,752 | 7/1955 | Italy | 403/DIG. 1 |
| 302,521 | 6/1971 | U.S.S.R. | 403/DIG. 1 |
| 302,523 | 6/1971 | U.S.S.R. | 403/DIG. 1 |

*Primary Examiner*—H. Hampton Hunter
*Attorney, Agent, or Firm*—Browdy and Neimark

[57] ABSTRACT

At least one needle-bearing bar of a quilting machine is connected to a reciprocable shaft, a control device is operatively arranged selectively to engage and to disengage the needle-bearing bar from the shaft. The control device includes either two electromagnetic or a pneumatically operated cylinder. A timer can be provided to effect energization of the electromagnets or fluid delivery to and venting of the cylinder.

1 Claim, 4 Drawing Figures

CONTROL DEVICE OF A NEEDLE-BEARING IN A QUILTING MACHINE

BACKGROUND OF THE INVENTION

The invention relates to a control device operatively associated with a needle-bearing bar in a quilting machine. Such a device can be used in either quilting machines having a single needle-bearing bar or in quilting machines having a plurality of needle-bearing bars.

In the conventional quilting machines, the control device of the needle-bearing bar has driving means inserted between a main control shaft of the machine and the needle-bearing bar. These driving means are suitable to convert, via cam means, the rotatory motion of the main shaft into a reciprocating movement of the needle-bearing bar. Such conventional driving means forms a non-disengageable connection between the main shaft and the needle-bearing bar and does not permit a temporaneous stopping of the needle-bearing bar and, consequently, of the stitching operation. When the quilting machine is in operation, the needle-bearing bar is constantly in movement, and accomplishment of discontinuous quiltings, in order to manufacture quilted articles having stitched patterns with pattern-free zones intervening therebetween, is not readily possible. In order to obtain quiltings of the foregoing type, it has been necessary with the known machines to stop the entire combination of parts forming the driving means of the needle-bearing bar to cause thereafter the article being quilted to advance a predetermined length, and finally to restore the working of the combination of parts forming the driving means of the needle bearing bar. Obviously, such operations must be repeated whenever a non-stitched zone has to be prepared. This makes the working of the quilting machine extremely difficult and complex and, consequently, also the electric equipment provided for actuating, in timed coordination, the various operations. Machines of this type generally use, for the preparation of discontinuous stitchings, a self-braking motor which, whenever a stitch-free zone has to be prepared, must lock the main shaft of the machine and enable a secondary control device for moving the article which must advance without being stitched. The working complexity of the conventional machines results in the impossibility of increasing the production rate beyond a given limit; consequently, the output is necessarily limited. As a result, the manufactured articles are expensive. There should be also considered the possible frequent drawbacks which can occur, such as e.g. article tearing caused by the article advancement, if the needle-bearing bar is not at the top dead center, i.e. the needles are not in raised position with respect to the article.

SUMMARY OF THE INVENTION

It is the principal object of the present invention to provide in an apparatus for driving at least one needle-bearing bar of a quilting machine, a control device of the needle-bearing bar in a quilting machine which overcomes the above-mentioned drawbacks and allows discontinuous quilting, the stitched zones having non-stitched zones intervening therebetween, without requiring that the main motor of the machine or of the main shaft be stopped.

The control device of a needle-bearing bar according to the present invention is characterized in that it has means for disengaging a reciprocating means from the needle-bearing bar.

The main advantage afforded by the control device of the present invention resides in that the device makes it possible to obtain discontinuous stitches without stopping the machine members, thus permitting either a continuous or an intermittent quilting without stopping the machine.

A further advantage of the control device of the present invention is that, during the preparation of a non-stitched zone, the advancement of the fabric takes place with the needle-bearing bar at the top dead center, thus avoiding tearing of the fabric.

A further advantage of the control device of the present invention is that the disengaging means are operable even at maximum quilting speed, without requiring any temporaneous slowing down which would result in a decrease of the number of quilted articles produced.

A further advantage is the continuity in production and consequently the decrease of the ultimate costs of the articles obtained.

BRIEF DESCRIPTION OF THE DRAWINGS

The foregoing and further advantages, objects and features of the control device according to the present invention are to become more apparent from the following detailed description given by way of non-limiting examples with reference to the accompanying drawings, wherein.

DETAILED DESCRIPTION OF THE PREFERRED EMBODIMENTS

Figure 1:
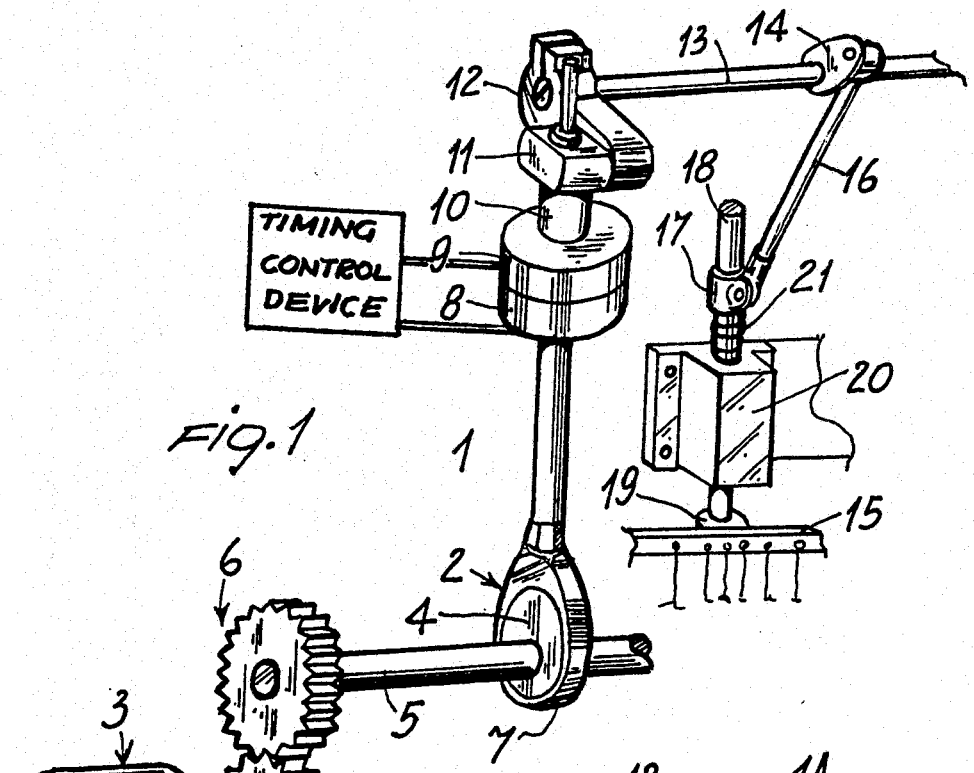
FIG. 1 is a perspective view showing a first embodiment of a control device according to the present invention, engaged with a needle-bearing bar at top dead center.
Figure 2:
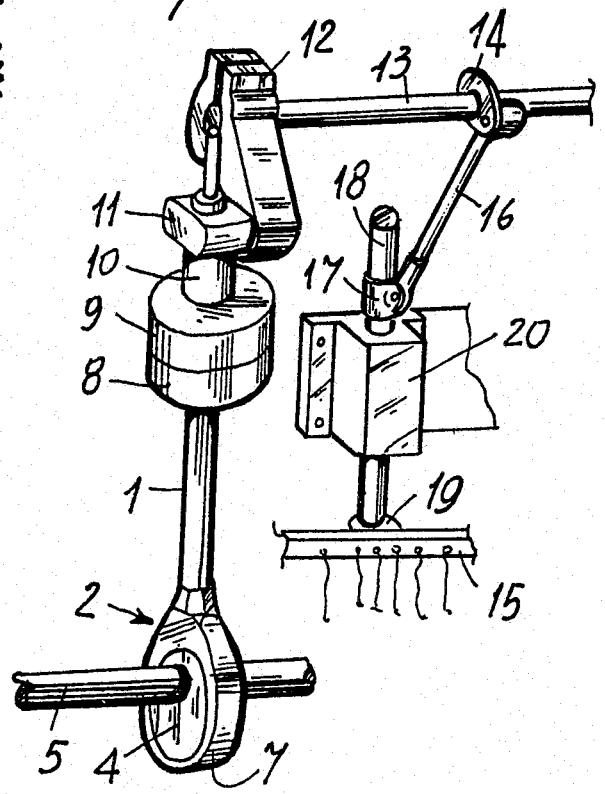
FIG. 2 is a perspective view showing the control device of FIG. 1, engaged with the needle-bearing bar at bottom dead center.
Figure 3:
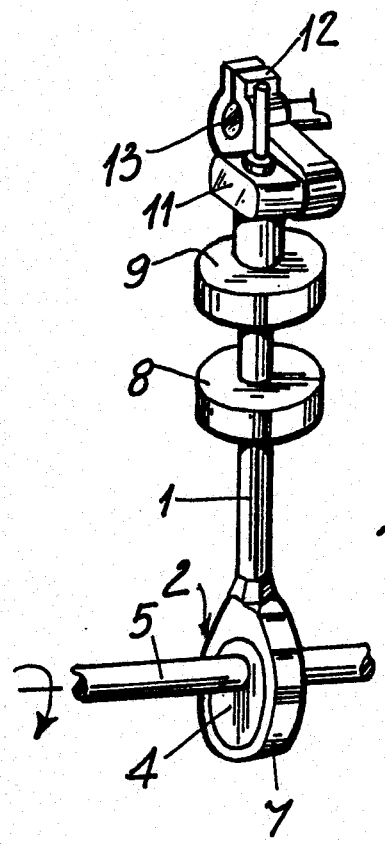
FIG. 3 is a perspective view showing the control device of FIGS. 1 and 2 when disengaged from the needle-bearing bar.

With specific reference to FIGS. 1–3, the control device of a needle-bearing bar includes a connecting rod in the form of a reciprocable rod 1 actuated, via a cam 2, by a main driving motor 3 of a quilting machine. The cam 2 has a circular plate 4 keyed on a shaft 5 which is rotated by the driving motor 3 via a reduction gear assembly 6. The circular plate 4 is rotatable within a collar 7, the rod 1 being fixed to the upper end of the collar 7. The rod 1 is fixed to the upper end of the collar 7 in a manner known per se, as is at present customary in conventional quilting machines. A first electromagnet 8 is fixed to the reciprocable rod 1 midway along its length in cooperation relationship with a second electromagnet 9 movable axially along the rod 1. The second electromagnet 9 is provided at its upper end with a cylindrical projection 10 connected, in any conventional manner, to a projection 11 provided at the end of an arm 12 keyed at its opposite end to a countershaft 13 having the purpose of transmitting the reciprocating motion to a number of mechanisms (only one being illustrated in FIGS. 1–3) connected to at least one needle-bearing bar 15. Each of these mechanisms includes a rod 16 pivoted at one of its ends to an arm 14 and at its opposite end pivoted to a sleeve 17 fastened on a shaft 18 connected rigidly at its lower end to the needle-bearing bar 15 via a bracket 19. The shaft 18 is slidable within a guide 20 fastened to the frame of the quilting machine in such a way as to assure that its movement, and consequently the movement of the needle-bearing bar 15, is always vertical. Between the sleeve 17 and the guide 20, spring 21 is provided for controlling the lifting of the needle-bearing bar 15 when the control device is disabled, as will become more apparent from the description below of the operation of the control device of the present invention.

Figure 4:
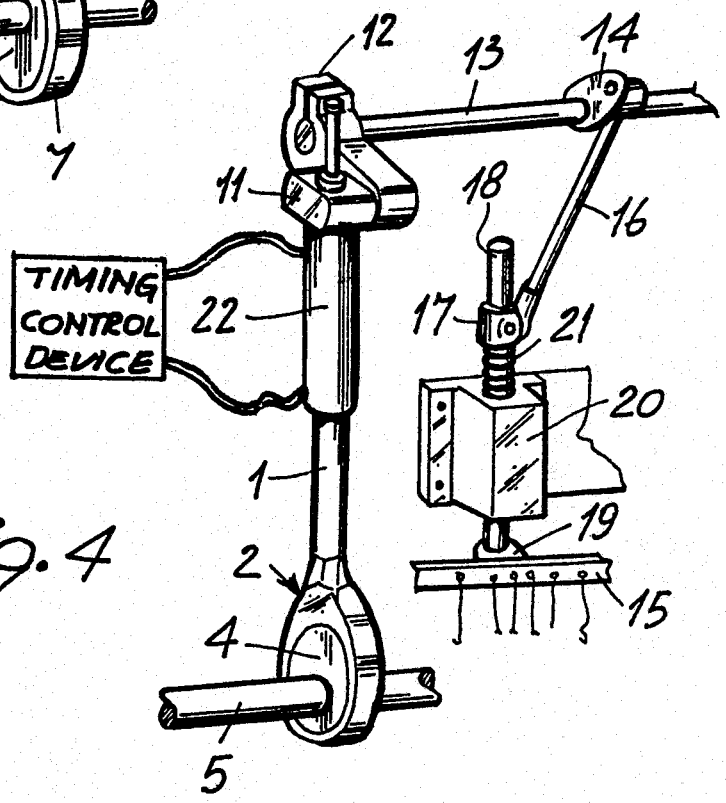
FIG. 4 is a perspective view showing a second embodiment of control device, which can be used in practicing the invention, engaged with a needle-bearing bar at top dead center.

With specific reference to FIG. 4, there is now described a further embodiment of the control device of the present invention in which the disengaging means are of the pneumatic type. In this case, a reciprocating rod 1 acts as a piston slidable within a cylinder 22 fastened at one end thereof to a projection 11 of an arm 12. As to the remaining parts, this further embodiment is identical to the previously described embodiment illustrated in FIGS. 1–3. In FIG. 4, like elements are designated by the same reference numerals.

The operation of the control device of FIGS. 1–3 is as set out below. After the quilting machine has been set so that it can operate normally, i.e. after the article to be quilted has been inserted and all of the inspections to check the various devices of actuation and stitching have been carried out, the quilting machine is started. If the leading portion of the article must be quilted, the electromagnets 8 and 9 have to be energized so that, remaining attracted to each other, they maintain the connection between the rod 1 and the countershaft 13 in such a way that the needle bearing bar 15 can accomplish its normal stitching movement.

When a non-stitched portion must be realized, i.e. the movement of the needle-bearing bar 15 has to be stopped, it is sufficient to de-energize the electromagnets 8 and 9 so as to disengage the rod 1 from the mechanism which otherwise keeps it connected to the needle-bearing bar 15. When the electromagnets 8 and 9 are de-energized, they detach from each other. The electromagnet 8 follows the movement of the rod 1, because it is fixed thereto, while the electromagnet 9 stops at a final position which, no matter at what time the de-energization takes place, corresponds to the top dead center of the needle-bearing bar 15.

It is a feature of the control device according to the present invention that the de-energization of the electromagnets 8 and 9 can take place at any moment, even at a different moment from that in which the needle-bearing bar 15 is at its top dead center. In fact, even if the de-energization is effected at a moment in which the needles are inserted within the article to be quilted, the movement of of the rod 1 is such as to cause, in any case, the upward motion of the needle-bearing bar 15 because the second electromagnet 9 and all the mechanical members connected thereto are pushed to an upward position where they stop, through action of the spring 21. Subsequently, the first electromagnet 8 descends again detaching from the second electromagnet 9. All of the control members of the machine are in motion. The electromagnets 8 and 9 are subsequently energized when stitching must be started again.

It is suitable that the position of the rod 1 corresponding to the top dead center of the needle-bearing bar 15 be such that the first electromagnet 8 is very close to second electromagnet 9, so as to bring about easily a further attraction to each other.

In case the leading zone of the article need not to be stitched, it is sufficient to start the machine with the electromagnets 8 amd 9 in de-energized condition, causing them to become energized when the stitching must be started, In order to control the subsequent energizations and de-energizations of electromagnets 8 and 9, a conventional electronic control device can be provided. This control device can be timed, thus making the operation of the quilting machine automatic.

The foregoing disclosures relating to the case in which the disengaging means is of electromagnetic type can be easily applied to the case in which the disengaging means is of pneumatic type, as is shown in FIG. 4. When the quilting machine has to effect the stitching of the article, it is sufficient to keep a preestablished pressure within the chamber of the cylinder 22 so as to block the position of the piston, i.e. the rod 1. This can be easily obtained by introducing a fluid under pressure into the cylinder 22. When the machine must provide a non-stitched zone, the delivery of fluid under pressure into the cylinder 22 is discontinued, and the pressure therein reduced by putting it in communication with the outer environment, thus disengaging the rod 1, which then moves freely within the cylinder 22. This latter stops at a final position corresponding to the top dead center of the needle-bearing bar 15. Also for this further embodiment, it is possible to provide a control device for the subsequent introductions of fluid and the attendant interruptions, which can be timed, thus making fully automatic the operation of the machine.

It is further to be understood that various changes and/or modifications can be made to the control devices of this invention, without departing from the spirit and scope thereof, its scope being defined by the appended claims.

What is claimed is:

1. In an apparatus which includes reciprocating means connected to at least one needle-bearing bar of a quilting machine for driving the needle-bearing bar, the improvement comprising a control device having means for disengaging said reciprocating means from said needle-bearing bar, said means comprising a reciprocable rod, a first electromagnet fastened to said reciprocable rod, a second electromagnet slidably mounted on said reciprocable rod, whereby the needle-bearing bar is engaged with the reciprocating means whenever the electromagnets are energized and disengaged when they are not energized, and an electronic timing means for automatically controlling subsequent energizations and de-energizations of said electromagnets.

* * * * *